US008758095B2

(12) United States Patent
Hutchins et al.

(10) Patent No.: US 8,758,095 B2
(45) Date of Patent: Jun. 24, 2014

(54) ABRADING OR POLISHING TOOL WITH IMPROVED MOTOR CHAMBER

(75) Inventors: Donald H. Hutchins, Sierra Madre, CA (US); Alme Hutchins, Sierra Madre, CA (US); Paul D. Maldini, Castaic, CA (US)

(73) Assignee: Hutchins Manufacturing Company, Pasadena, CA (US)

( * ) Notice: Subject to any disclaimer, the term of this patent is extended or adjusted under 35 U.S.C. 154(b) by 411 days.

(21) Appl. No.: 13/106,731

(22) Filed: May 12, 2011

(65) Prior Publication Data

US 2012/0289136 A1 Nov. 15, 2012

(51) Int. Cl.
*B24B 23/00* (2006.01)
*B24B 23/02* (2006.01)

(52) U.S. Cl.
CPC ..... *B24B 23/00* (2013.01); *B24B 23/026* (2013.01)
USPC ..... 451/344; 451/359

(58) Field of Classification Search
CPC ..... B24B 23/026
USPC ..... 451/451, 344, 358, 359, 360, 363, 294, 451/295
See application file for complete search history.

(56) References Cited

U.S. PATENT DOCUMENTS

| | | | | | |
|---|---|---|---|---|---|
| 1,143,725 | A | | 6/1915 | Reed | |
| 2,077,693 | A | | 4/1937 | Herrero | |
| 2,326,396 | A | * | 8/1943 | Schaedler | 418/43 |
| 3,283,352 | A | | 11/1966 | Hu | |
| 3,890,069 | A | | 6/1975 | Telang et al. | |
| 4,058,936 | A | | 11/1977 | Marton | |
| 4,103,460 | A | * | 8/1978 | Law | 451/344 |
| 4,177,024 | A | * | 12/1979 | Lohn | 418/16 |
| 4,232,414 | A | * | 11/1980 | Curtiss | 451/295 |
| 4,434,587 | A | | 3/1984 | McDougall | |
| 4,592,170 | A | * | 6/1986 | Hutchins et al. | 451/357 |
| 4,660,329 | A | * | 4/1987 | Hutchins | 451/357 |
| 4,671,019 | A | | 6/1987 | Hutchins | |
| 4,839,995 | A | | 6/1989 | Hutchins | |
| 4,854,085 | A | | 8/1989 | Huber | |
| 4,924,633 | A | | 5/1990 | Hock et al. | |
| 4,924,636 | A | | 5/1990 | Hoffman | |
| 4,986,036 | A | * | 1/1991 | Hutchins | 451/344 |
| 5,007,778 | A | | 4/1991 | Hillestad et al. | |
| 5,165,881 | A | | 11/1992 | Wicen | |
| 5,245,243 | A | | 9/1993 | Ohnishi et al. | |
| 5,253,990 | A | * | 10/1993 | Hutchins | 418/270 |
| 5,319,888 | A | * | 6/1994 | Huber et al. | 451/357 |
| 5,347,673 | A | | 9/1994 | Nickels, Jr. | |
| 5,392,568 | A | | 2/1995 | Howard, Jr. et al. | |
| 5,411,386 | A | | 5/1995 | Huber et al. | |
| 5,445,558 | A | | 8/1995 | Hutchins | |
| 5,464,366 | A | | 11/1995 | Hutchins | |

(Continued)

*Primary Examiner* — Lee D Wilson
*Assistant Examiner* — Tyrone V Hall, Jr.
(74) *Attorney, Agent, or Firm* — Christie, Parker & Hale, LLP

(57) ABSTRACT

The present invention relates to an abrading or polishing tool with an improved motor chamber, and more particularly to a tool with a motor chamber having a sleeve or liner lining the inside surface of the motor chamber. In one embodiment, an abrading or polishing tool includes a body defining an internal motor chamber with an inner surface, a liner lining the inner surface of the motor chamber, a rotor contained within the motor chamber for rotation against the liner, and an abrading or polishing head coupled to the rotor for rotation.

17 Claims, 9 Drawing Sheets

(56) References Cited

U.S. PATENT DOCUMENTS

| | | | | |
|---|---|---|---|---|
| 5,518,441 | A | 5/1996 | Valentini | |
| 5,580,302 | A * | 12/1996 | Howard et al. | 451/357 |
| 5,582,541 | A | 12/1996 | Hutchins | |
| 5,595,530 | A | 1/1997 | Heidelberger | |
| 5,597,348 | A | 1/1997 | Hutchins | |
| 5,823,862 | A | 10/1998 | Heidelberger | |
| 5,879,228 | A | 3/1999 | Sun | |
| 6,007,412 | A | 12/1999 | Hutchins | |
| 6,190,245 | B1 | 2/2001 | Heidelberger et al. | |
| 6,257,970 | B1 * | 7/2001 | Huber | 451/357 |
| 6,390,477 | B1 | 5/2002 | Drago et al. | |
| 6,485,360 | B1 | 11/2002 | Hutchins | |
| 6,752,705 | B1 * | 6/2004 | Lin | 451/295 |
| 7,008,187 | B2 | 3/2006 | Cazzaniga | |
| 7,220,098 | B2 | 5/2007 | Bruce et al. | |
| 7,662,027 | B2 | 2/2010 | Hutchins | |
| 2003/0143935 | A1 * | 7/2003 | Huber | 451/357 |
| 2005/0170763 | A1 * | 8/2005 | Sun et al. | 451/359 |
| 2006/0073032 | A1 | 4/2006 | Parrett | |
| 2006/0110246 | A1 | 5/2006 | Bruce | |
| 2008/0076337 | A1 | 3/2008 | Hutchins | |
| 2008/0160887 | A1 * | 7/2008 | Hutchins | 451/357 |
| 2008/0160888 | A1 | 7/2008 | Hutchins | |
| 2008/0219877 | A1 | 9/2008 | Kjeldsen et al. | |

* cited by examiner 10
22
91a
24
26
40
14
12
16
94
28
18
30
20
4
4

ABRADING OR POLISHING TOOL WITH IMPROVED MOTOR CHAMBER

FIELD OF THE INVENTION

The present invention relates to an abrading or polishing tool with an improved motor chamber, and more particularly to a tool with a motor chamber having a sleeve or liner lining the inside surface of the motor chamber.

BACKGROUND

A known orbital abrading or polishing tool includes an air-driven motor including a rotor that rotates within a motor housing inside a motor chamber. Compressed air is delivered through an inlet to the motor housing to cause rotation of the rotor. The rotor transmits rotational force to a carrier part that carries an abrading or polishing head. A key extends from the carrier part and engages a keyway in the rotor, such that rotation of the rotor causes a corresponding rotation of the carrier part and the abrading or polishing head. The polishing head can be centered about an axis that is offset from the axis of rotation of the motor, to give the polishing head an orbital movement.

Such tools often include an external body and a separate rigid motor housing piece that is inserted into the body to contain the rotor. The motor housing provides an internal surface against which the rotor rotates. The separate motor housing piece may be made of a homogeneous composition of steel or other wear-resistant material that can withstand the wear of the rotor rotating at high speed against the inner surface of the housing. The rotor can cause substantial friction against the inner surface of the housing, and thus these tools often incorporate a robust homogeneous motor housing formed from a wear-resistant material.

However, the homogeneous motor housing piece adds significant weight to the tool and is expensive to replace after extended wear. Accordingly, a need exists for an improved motor chamber for an orbital abrading or polishing tool.

SUMMARY

The present invention relates to an abrading or polishing tool with an improved motor chamber, and more particularly to a tool with a motor chamber having a sleeve or liner lining the inside surface of the motor chamber. In one embodiment, an abrading or polishing tool includes a tool body with a hollow interior that defines a cylindrical motor chamber. A rotor rotates within this chamber in response to the introduction of compressed air into the chamber. In this embodiment, the motor chamber is formed within the tool body itself, rather than being defined by an external, separate motor housing piece. The motor chamber within the tool body is lined by a sleeve or liner that is inserted into the chamber along the inner surface of the chamber. The sleeve provides a wear-resistant inner surface for rotation of the rotor, while reducing the overall weight of the tool. A bearing cup is attached, to the tool body to close the motor chamber and locate the rotor for accurate rotation within the motor chamber. The improved motor chamber is wear-resistant, lightweight, and easy to assemble and disassemble.

In one embodiment, an abrading or polishing tool includes a body defining an internal motor chamber with an inner surface, a liner lining the inner surface of the motor chamber, a rotor contained within the motor chamber for rotation against the liner, and an abrading or polishing head coupled to the rotor for rotation.

In one embodiment, a pneumatic abrading or polishing tool includes a tool body having a hollow interior defining an integral motor chamber with an inner surface. The tool also includes a sleeve lining the inner surface of the motor chamber, a rotor contained within the motor chamber for rotation against the sleeve, a carrier part coupled to the rotor for rotation therewith, and an abrading or polishing head attached to the carrier part.

In one embodiment, a method for manufacturing a pneumatic abrading or polishing tool includes integrally forming a tool body having a hollow interior that defines an offset motor chamber with a curved internal surface. The method also includes inserting a liner against the curved internal surface of the motor chamber, inserting a lower bearing cup into the hollow interior to close the motor chamber, and providing a rotor for rotation within the motor chamber.

DETAILED DESCRIPTION

The present invention relates to an abrading or polishing tool with an improved motor chamber, and more particularly to a tool with a motor chamber having a sleeve or liner lining the inside surface of the motor chamber. In one embodiment, an abrading or polishing tool includes a tool body with a hollow interior that defines a cylindrical motor chamber. A rotor rotates within this chamber in response to the introduction of compressed air into the chamber. In this embodiment, the motor chamber is formed within the tool body itself, rather than being defined by an external, separate motor housing piece. The motor chamber within the tool body is lined by a sleeve or liner that is inserted into the chamber along the inner surface of the chamber. The sleeve provides a wear-resistant inner surface for rotation of the rotor, while reducing the overall weight of the tool. A bearing cup is attached to the tool body to close the motor chamber and locate the rotor for accurate rotation within the motor chamber. The improved motor chamber is wear-resistant, lightweight, and easy to assemble and disassemble.

Figure 1:
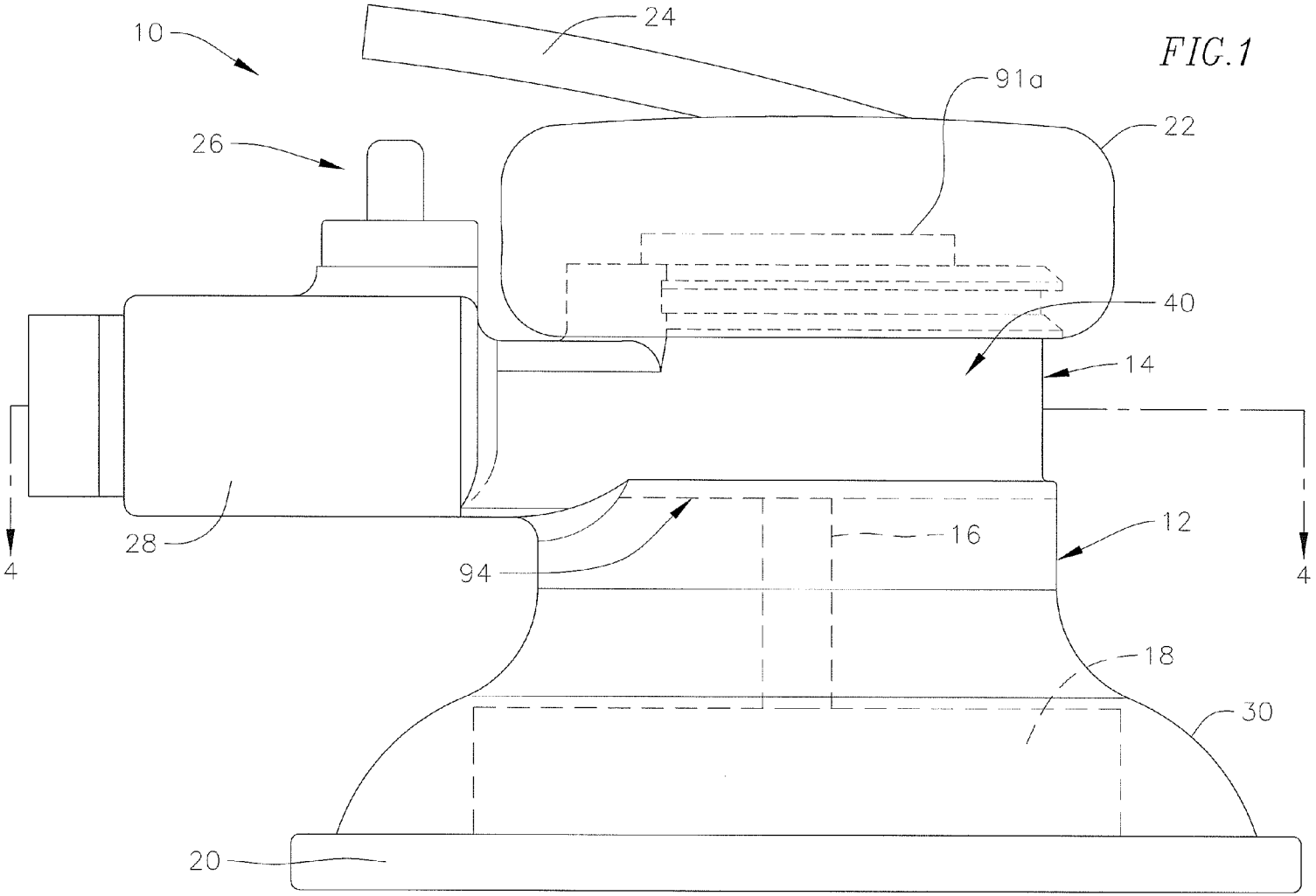
FIG. 1 is a side elevational view of an abrading or polishing tool according to an embodiment of the invention.

An abrading or polishing tool 10 is shown in FIG. 1. The tool 10 includes a body 12 which houses an internal motor 14. The motor 14 is connected to a shaft 16 that is coupled to a carrier part 18. An abrading or polishing head 20 is attached to the carrier part 18. The shaft, carrier part, and polishing head rotate in response to rotation of the motor. A cushion or handle 22 is secured to the top of the body 12, with a lever 24 extending above the handle. In one embodiment the handle is made of rubber. To operate the tool, a user grips the handle 22 and pushes down on the lever 24, which operates a valve assembly 26. The valve assembly 26 controls the flow of compressed air to the motor 14. When the valve is opened, the compressed air enters the motor through an intake passage and causes a rotor inside the motor to rotate. This rotation is ultimately transmitted to the head 20 to produce a desired abrading or polishing action.

FIG. 1 also shows a shroud 30 connected to the bottom end of the body 12. The shroud defines a confined space surrounding the head 20 to effectively draw debris created by the abrading or polishing action to a receptacle (not shown). The shroud collects this dust and debris for easier disposal. In one embodiment, the shroud is made from a polyurethane material.

Figure 2:
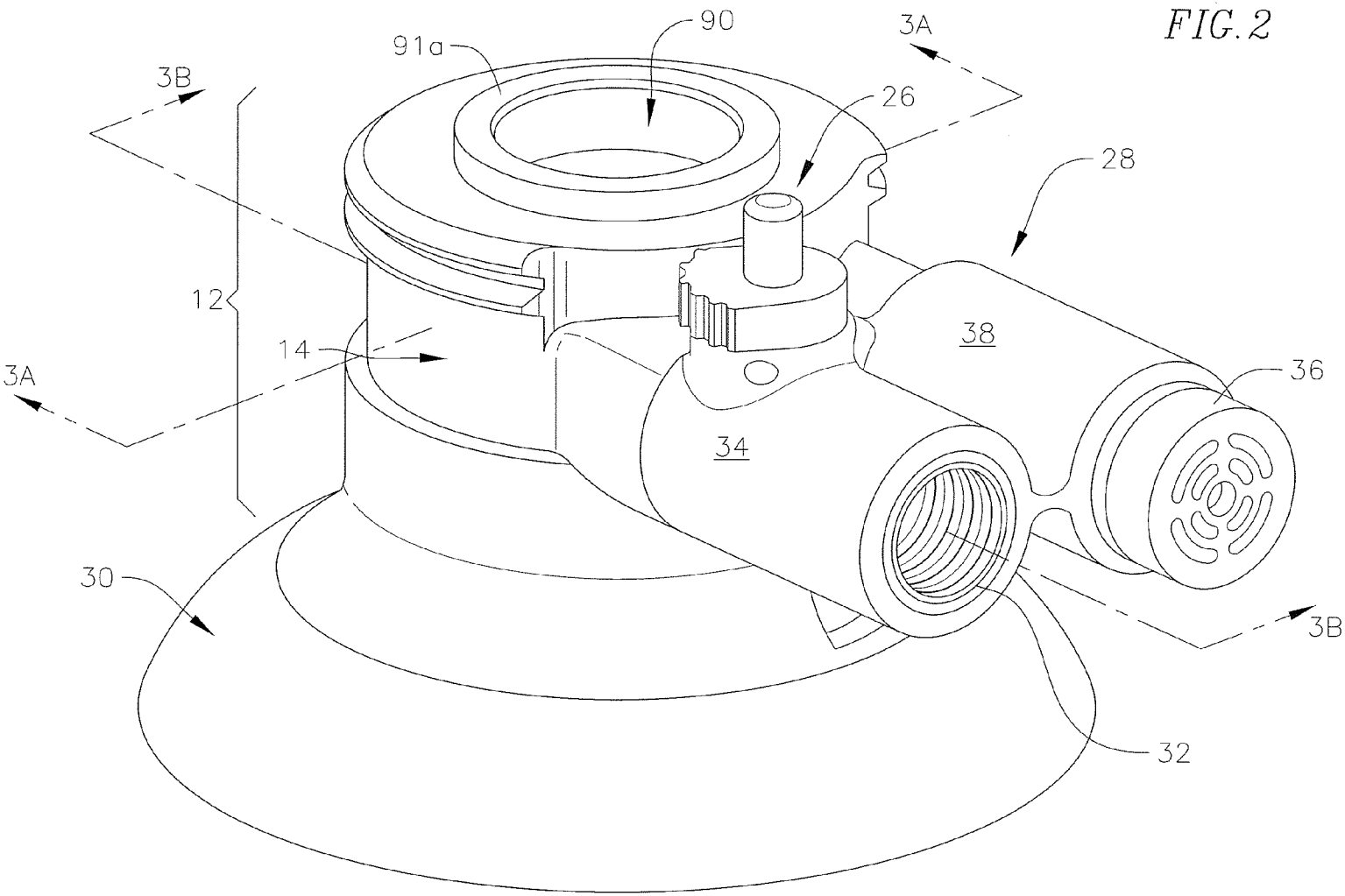
FIG. 2 is a perspective view of the tool of FIG. 1, with the handle, lever, and abrading head removed for clarity.

A perspective view of the body 12 with the attached shroud 30 is shown in FIG. 2. The body 12 includes a block 28 at one end. The block 28 includes an inlet port 32 leading to an inlet tube 34, and an exhaust port 36 at the end of an exhaust tube 38. The inlet port 32 can be connected to a source of compressed air, such as an air canister or a tube (not shown) leading to an air supply. The air passes through the port 32 and into the inlet tube 34. Further flow of air is controlled by the valve assembly 26, which selectively blocks or allows flow to the motor 14 inside the body 12. The flow of compressed air operates the rotor, as described in further detail below, and then passes through the exhaust tube 38 to the exhaust port 36, which can be connected to an exhaust hose (not shown).

Figure 3A:
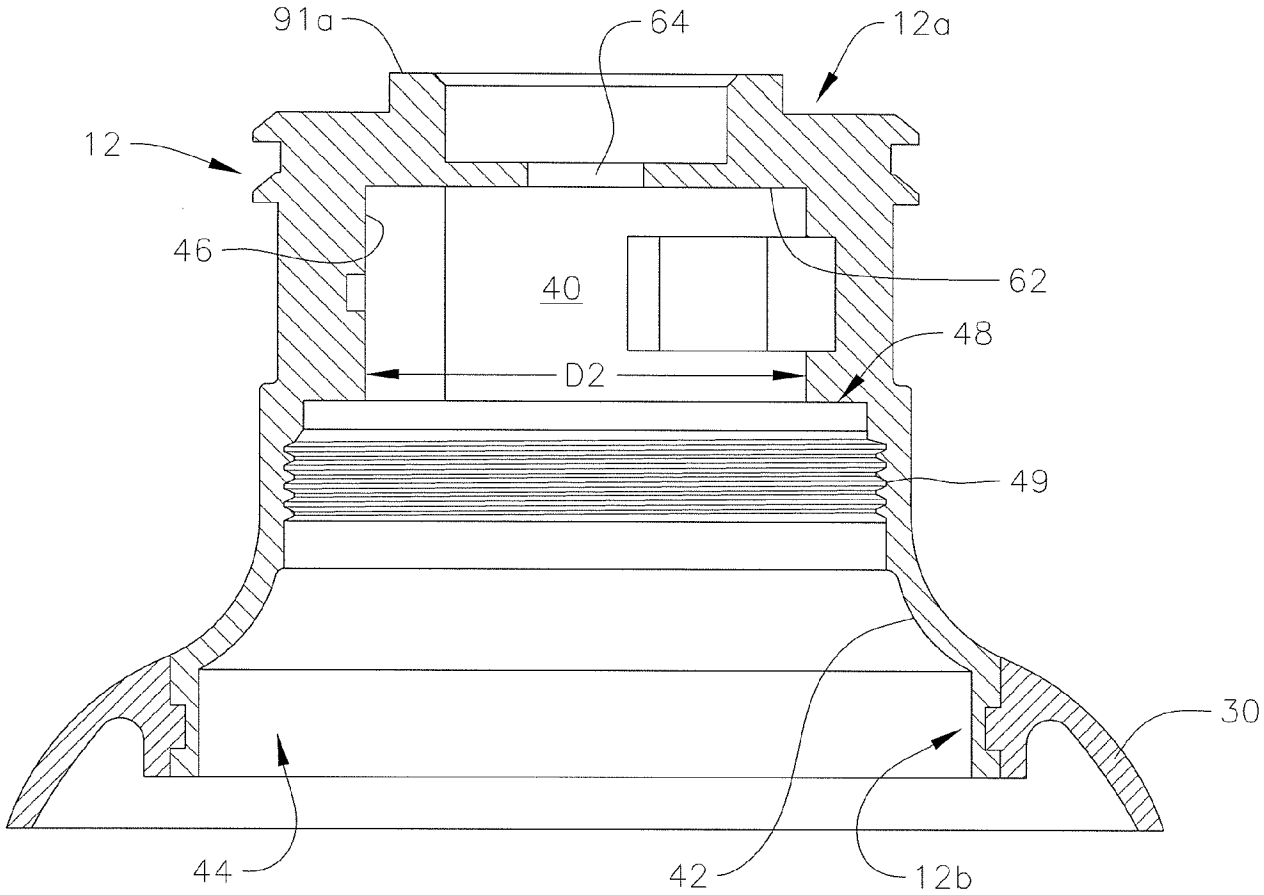
FIG. 3A is a vertical cross-sectional view of the tool of FIG. 2, taken along the line 3A-3A.
Figure 3B:
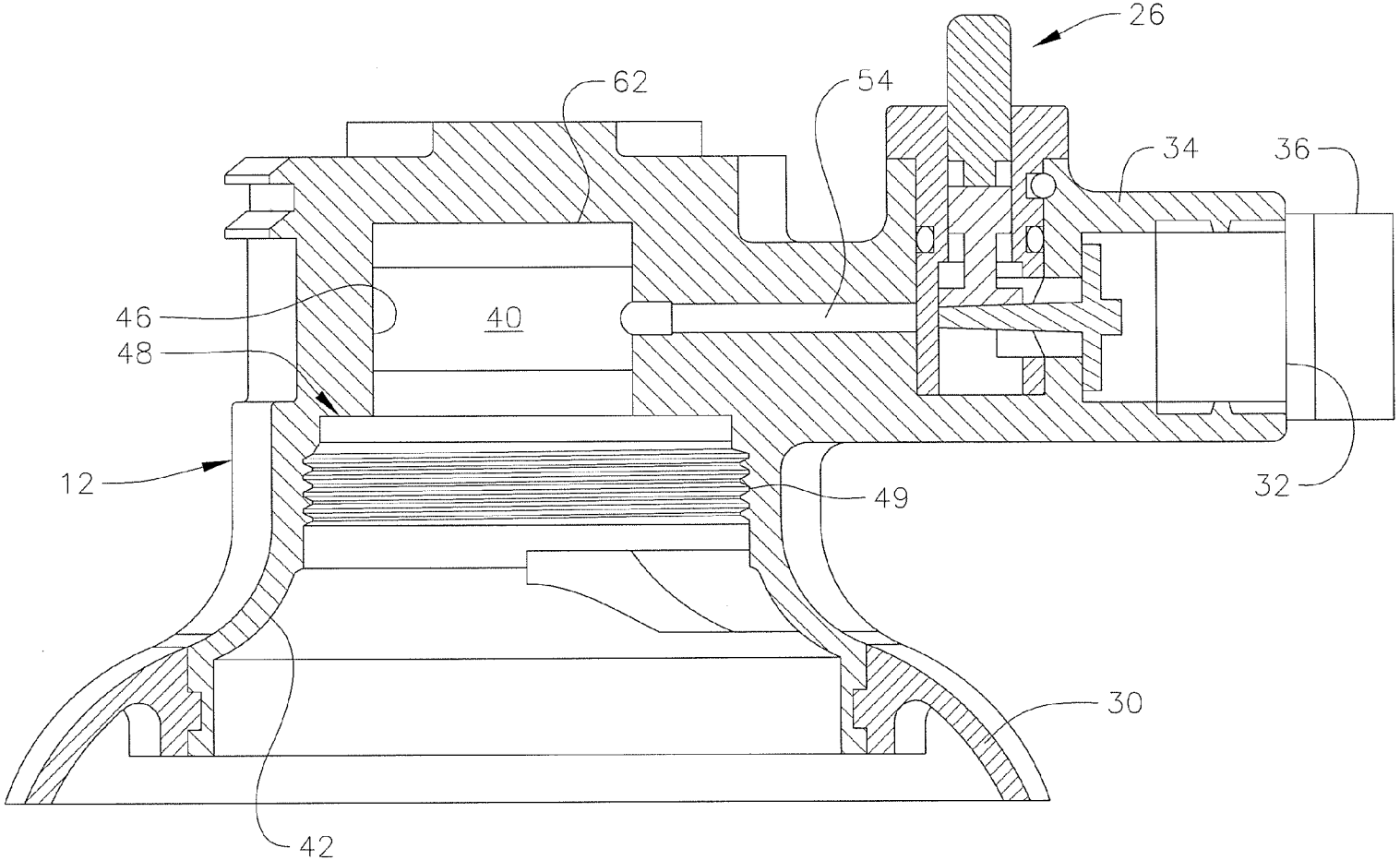
FIG. 3B is a vertical cross-sectional view of the tool of FIG. 2, taken along the line 3B-3B.

FIGS. 3A and 3B show cross-sectional views of the body 12 and shroud 30, taken through lines 3A-3A and 3B-3B respectively (shown in FIG. 2). As shown in these figures, the body 12 includes an interior surface 42 that defines a hollow interior 44. The body 12 includes a generally closed top end 12*a* and an open bottom end 12*b*. An opening passes through the closed top end 12*a*, as described in more detail below. Near the top end 12*a* of the body, the hollow interior 44 forms a cylindrical motor chamber 40 with a curving vertical side wall 46. Just below the motor chamber 40, the interior surface 42 of the body 12 extends outwardly, forming a shoulder 48. Below the shoulder, the surface 42 is provided with threads 49. The interior surface 42 then widens as it approaches the lower end 12*b* of the body.

In one embodiment, the body 12 is made of a rigid polymer material, such as nylon or another suitable material. In one embodiment the material is a 25% glass-filled nylon. The body 12 may be formed by injection molding.

The motor chamber 40 is defined by the cylindrical side wall 46, above the step 48, and below the top end 12*a* of the body 12. In particular, the top end 12*a* of the body includes an annular flange 62 that extends inwardly over the motor chamber 40. A passageway 64 extends through the center of the top end 12*a*, through the flange 62. In the embodiment shown, the chamber 40 is integrally formed within the hollow interior 44 of the body 12. That is, the motor chamber 40 is formed by the body 12 itself, rather than being defined by a separate motor housing piece inserted into the body 12. As a result, the motor chamber 40 is formed to provide the desired shape for receiving the rotor itself, rather than simply providing a receptacle for a motor housing piece that in turn receive the rotor. The desired shape of the chamber for the rotor is built into the internal surface 42, rather than being defined by a separate housing piece. As discussed in further detail below, this integrated motor housing 40 defined by the internal surface 42 leads to changes in the offset shape of the motor chamber and the inlet and exhaust ports, as compared to prior art tools with a separate motor housing piece.

Figure 4:
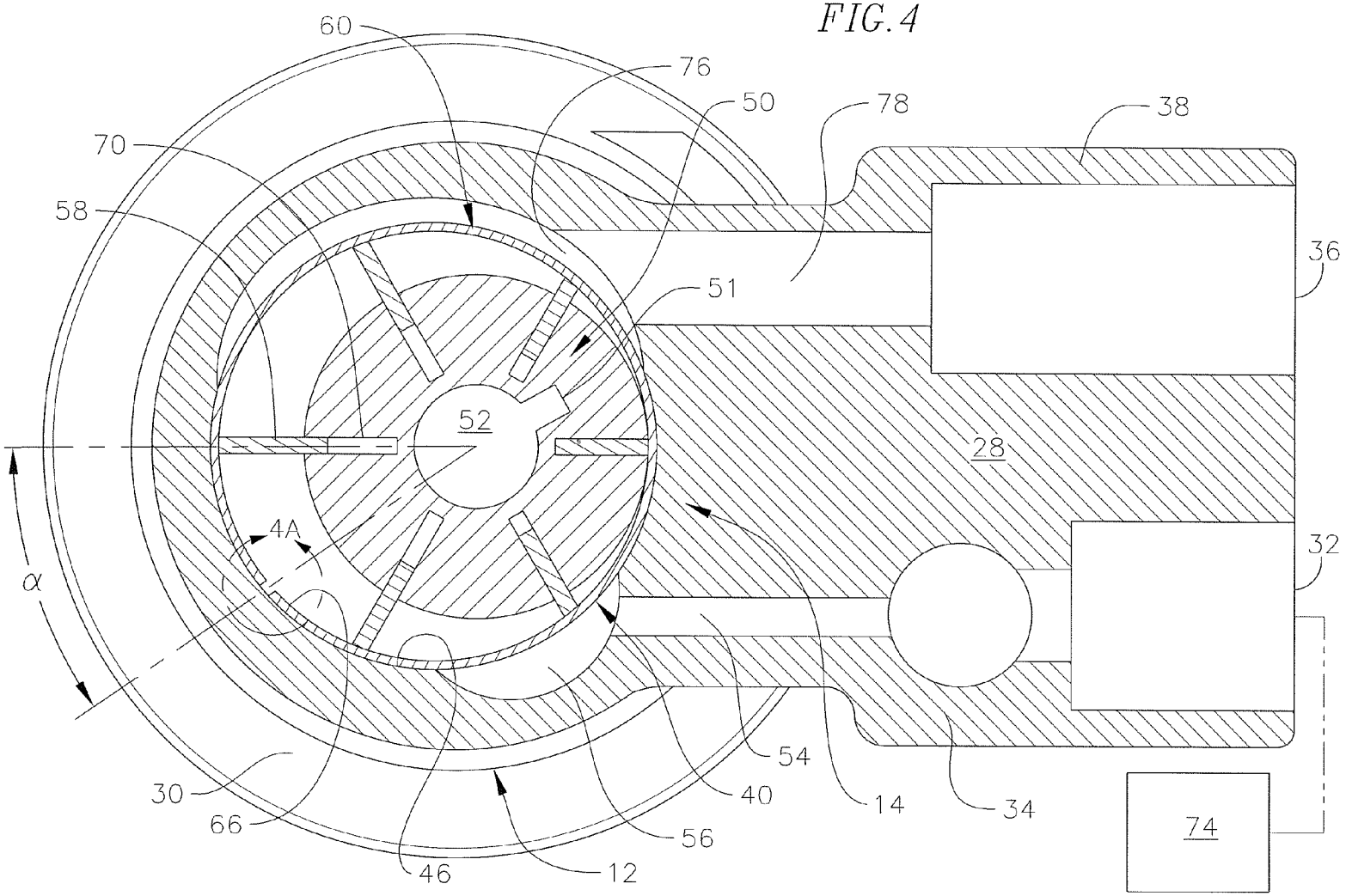
FIG. 4 is a horizontal cross-sectional view of the tool of FIG. 2, taken along the line 4-4 (shown in FIG. 1 for clarity).

FIG. 4 is a cross-sectional view of the body 12, taken along line 4-4 in FIG. 1, showing an assembled motor 14 inside the motor chamber 40. A rotor 50 is contained within the motor chamber 40. The rotor 50 includes a central passageway 52 for engagement with a shaft (described below) to transmit rotation from the rotor to the abrading or polishing head attached to the tool. The rotor 50 rotates within the motor chamber 40 in response to the introduction of compressed air through an inlet passage 54, into an inlet depression 56, and into the motor chamber 40, causing the rotor to rotate. Rotation of the rotor 50 is described in more detail below.

In the embodiment of FIG. 4, the side wall 46 of the motor chamber 40 is lined or covered by a sleeve or liner 60. (The thickness of the sleeve 60 has been exaggerated in FIG. 4 for clarity.) The sleeve 60 forms a shell that lines the inside surface of the wall 46. The inner surface 66 of the sleeve 60 faces into the motor chamber and provides the inner surface against which the rotor 50 rotates. The sleeve 60 is made from a wear-resistant material that can withstand the repeated friction of the rotor 50 (and vanes 58, described below) sliding against the inner surface 66 of the sleeve 60. With the sleeve 60 in place to protect the motor chamber 40, it is not necessary to insert a separate motor housing piece into the interior 44 of the body 12 to enclose the rotor. Instead, the motor chamber 40 is formed within the body 12 itself. Also, due to the protection provided by the sleeve 60, the material used to form the body 12 need not provide the same level of wear resistance as provided by the sleeve 60. Thus, the motor chamber 40 can be formed integrally within the interior 44 of the body 12, without a separate insertable wear-resistant motor housing piece. The body 12 can be made from a comparatively lightweight, inexpensive material without causing undesirable wear along the inside surface of the motor chamber 40.

The mechanics of the rotation of the rotor 50 within the motor chamber 40 will now be described with reference to FIG. 4. The rotor 50 includes a series of slots 70 that each slidably receive a vane 58. Six vanes 58 are shown in FIG. 4, although in other embodiments, a different number of vanes may be used, such as five vanes. The vanes 58 slide in and out of the slots 70 as the rotor rotates. The vanes 58 maintain contact with the inner surface 66 of the sleeve 60 as they rotate with the rotor. The outer end of the vanes 58 slide against this inner surface 66. The vanes thus form a series of air compartments 72 between the vanes. Compressed air from a source 74 (shown schematically) enters the body 12 through the inlet port 32 and passes through the inlet tube 34. When the tool is being operated and the valve assembly 26 is open, the air continues through the valve and through the inlet passage 54 to a recess 56 formed in the side wall 46 of the motor chamber 40. A slot in the sleeve 60 (shown in FIG. 5) aligns with this recess 56 and allows the air to enter the chamber 40 through the sleeve. The air enters one of the compartments 72 between the vanes, and the compressed air pushes against the vane and expands the compartment, causing the rotor to rotate in a clockwise direction (as viewed from FIG. 4). As the air expands and the rotor rotates, the air compartment increases in size, as shown in FIG. 4. The energy stored in the compressed air is thus transferred into the rotation of the rotor as the air expands and pushes on the vane. When the air has expanded and the rotor has rotated, the air compartment reaches the exhaust recess 76 formed in the wall 46. Another slot in the sleeve 60 allows the expanded air to exhaust through the recess 76 and through exhaust passage 78 to the exhaust tube 38. The exhaust tube 38 may be attached to a discharge hose. The air compartment reduces in size as the air exhausts, until the compartment reaches the inlet depression 56 again and another cycle of rotation begins.

Because the motor chamber 40 is integrally formed within the body 12 itself, the inlet and exhaust passages are modified to lead directly into this chamber, rather than passing through a separate housing piece. As shown in FIG. 4, the inlet passage 54 connects the air source to the motor chamber 40, leading to the recess 56 formed along the interior side wall 46. As described below, an opening in the spring allows this air to pass into the compartments between the vanes. The outlet passage 78 connects the motor chamber, at the recess 76, to the exhaust tube 38. The passages 54, 78 and recesses 56, 76 are integrally molded directly into the shape of the body 12, rather than being provided by a separate piece.

The rotor 50 includes a central passage 52 for connection to the shaft 16 and ultimately the abrading or polishing head 20 (FIG. 1). The central passage 52 is offset or eccentric with respect to the shape of the motor chamber 40, as shown in FIG. 4. Due to the mechanics of operation of the rotor 50 with the vanes 58 and expanding air compartments 72, the motor chamber 40 is not centered about the passage 52. This offset shape of the motor chamber 40 is built into the body 12 by the shape of the interior surface 42 forming the motor chamber 40. It is not necessary to insert another piece into the interior of the body 12 to create the eccentric motor chamber 40 and offset it from the passage 52 and shaft 16. This offset shape of the motor chamber 40 is integrally built into the interior of the body 12.

Figure 5:
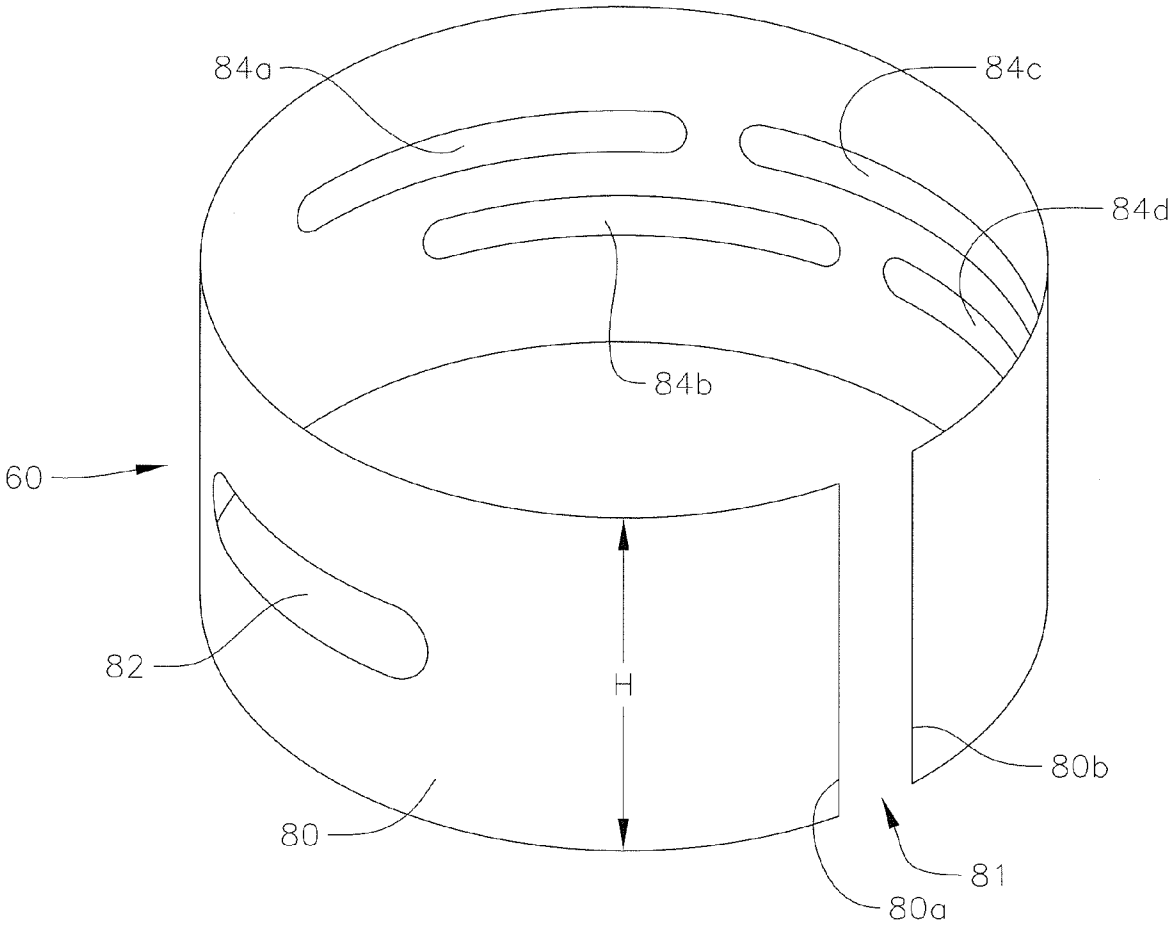
FIG. 5 is a perspective view of a sleeve according to an embodiment of the invention.

In one embodiment, the sleeve 60 is formed of a material suitable for a clock spring or leaf spring, such as the spring or spring liner 80 shown in FIG. 5. In this embodiment, the sleeve 60 is a thin material with a uniform or constant thickness, curved into a coil or circular shape with the opposite ends 80*a*, 80*b* facing each other. In one embodiment the diameter of the spring 80 after it is curved is approximately 1.5 inches in its relaxed state, and the height H of the spring is about 0.75 inches. In one embodiment the material for the spring is steel. In one embodiment the material is 1095 blue clock spring steel, with a thickness of about 0.015 inches.

The material of the sleeve 60 acts as a spring in that it tends to recover its shape if the ends are moved away from each other to expand the circle, or toward each other to close it. In its natural state, the spring 80 rests with a gap 81 between the two ends 80*a*, 80*b*. In one embodiment, the spring in its natural resting state has a diameter D1 that is greater than the diameter D2 (see FIG. 3A) of the motor chamber 40, measured between opposite sides of the wall 46. As a result, the spring 80 is compressed, moving the ends 80*a*, 80*b* toward each other, in order to fit into the motor chamber along the wall 46. The compression of the spring 80 tends to hold it in place inside the motor chamber 40, as the spring urges outwardly against the wall 46. As a result, in one embodiment, the sleeve 60 is firmly and securely seated against the wall 46 without the need for adhesive or glue to hold it in place. Additionally, the sleeve can be easily removed and replaced by inserting a tool to grip the sleeve and bend it inwardly away from the wall 46. If desired, glue or adhesive can be applied between the sleeve 60 and the wall 46 to further secure the sleeve in place, but this is optional.

The sleeve includes openings formed through the thin material of the spring at strategic locations, such as a first slot 82 near end 80*b* and a series of offset slots 84*a*, 84*b*, 84*c* near the opposite end 80*a*. In one embodiment, the offset slots 84*a-c* align with the inlet depression 56 in the motor chamber 40 when the sleeve is inserted into the chamber, and the slot 82 aligns with the exhaust recess 76. These slots through the spring enable air flow to enter and exit the motor chamber 40.

Figure 4A:
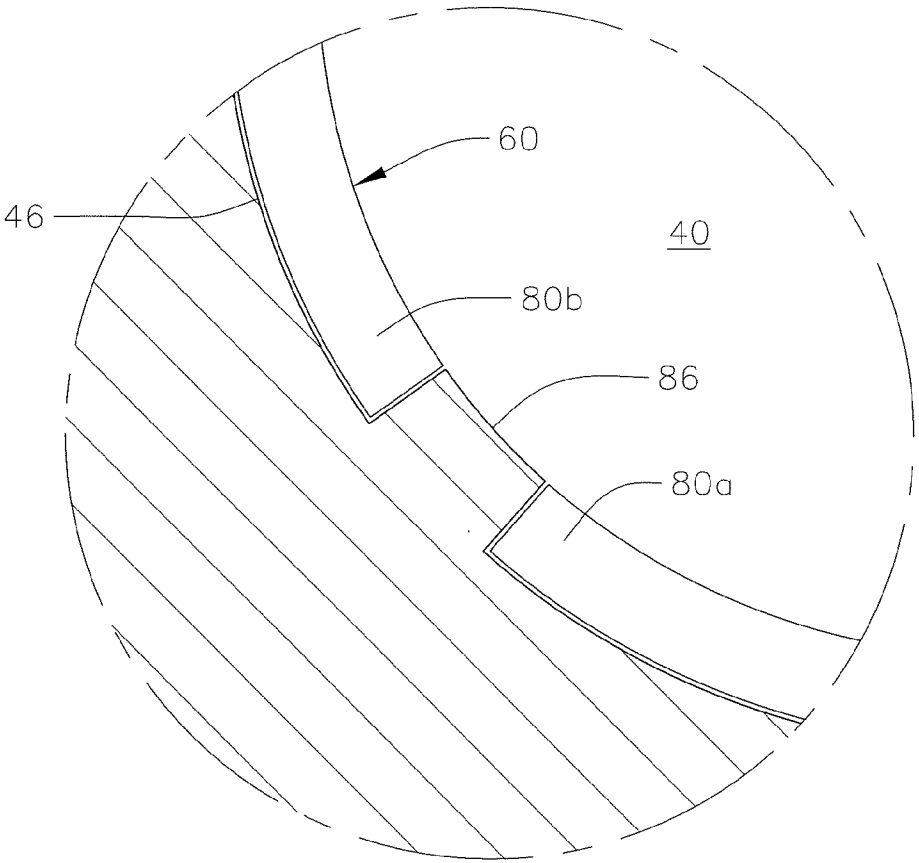
FIG. 4A is an enlarged view of area 4A in FIG. 4.

In one embodiment, the sleeve or liner 60 engages a rib or protrusion 86 to align the sleeve 60 within the motor chamber (shown only in FIG. 4A, for clarity). The rib 86 extends from the wall 46 on the interior surface of the motor chamber 40 (see FIGS. 4, 4A). When the spring 80 is used for the sleeve 60, the spring is compressed, moving the ends 80*a* and 80*b* toward each other, and then inserted into the motor chamber 40. The spring is then released, allowing the ends to move outwardly, until the first end 80*a* of the spring is seated on a first side of the rib 86, and the second side 80*b* of the spring is seated on the opposite side of the rib 86, with the rib 86 separating the two ends 80*a*, 80*b* (see FIG. 4). The rib rotationally aligns the spring such that the openings (such as slots 82 and 84*a-c*) in the spring align with the inlet and outlet passages 56, 76 for flow of air through the spring and into and out of the motor chamber.

In one embodiment, the length of the rib 86 extending out from the wall 46 is about the same as the thickness of the sleeve 60. In one embodiment this length (and the thickness of the sleeve) is about 0.012 inches, or between about 0.012 inches and about 0.014 inches. In one embodiment the rib 86 is about 0.010 inches wide, and is about the same height as the motor chamber 40. The rib 86 may be located circumferentially around the motor chamber 40 anywhere as convenient, with the gap 81 in the sleeve located accordingly. In FIG. 4 the rib 86 is located angularly about 30° counterclockwise from the top centerline (as noted by angle $\alpha$).

Figure 6:
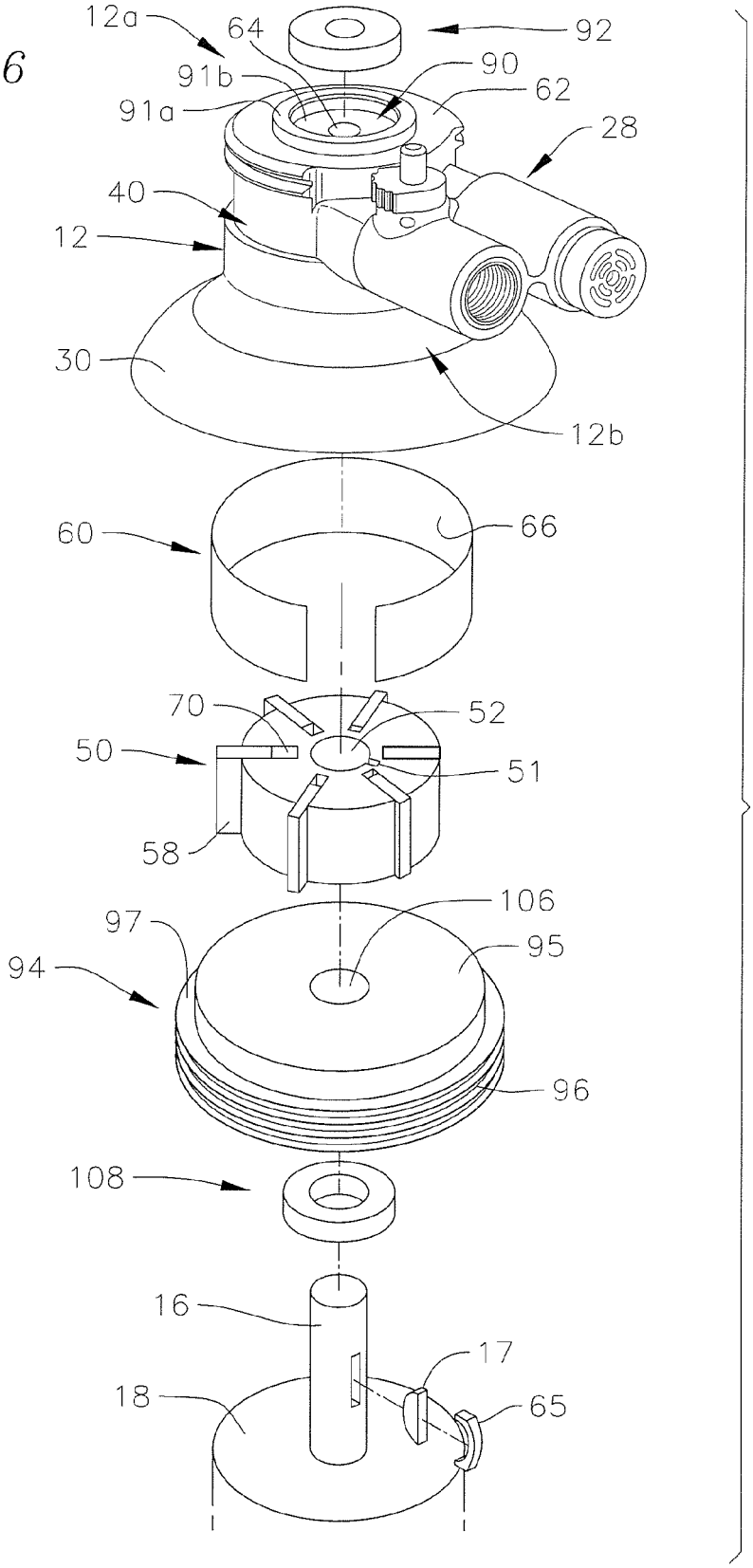
FIG. 6 is an exploded view of an abrading or polishing tool according to an embodiment of the invention.

An exploded view of various components of the tool 10 is shown in FIG. 6, to show how the various components fit together. The top end 12*a* of the body 12 includes a passage 64 that accepts a top end of the shaft 16. The top end 12*a* of the body 12 also includes a seat 90 for an upper bearing 92. The seat 90 is formed by a raised ring 91*a* that defines a depression or recess 91*b* within the ring. The upper bearing 92 is received by the seat 90 into the recess 91*b*, and engages the top end of the rotating shaft 16. The upper bearing 92 may also be referred to as a wear plate, as it accepts the top end of the shaft 16, which rotates against the bearing. In one embodiment, the upper bearing 92 is molded into the body 12 of the tool, rather than being inserted or assembled later. For example, the upper bearing 92 may be a steel washer with a central hole, molded into the top end of the body. The upper end of the shaft 16 rotates against this bearing.

The motor chamber 40 is located below the top end 12*a* of the body 12, under the flange 62 (also shown in FIGS. 3A, 3B). The motor chamber 40 is aligned with the block 28 which includes the inlet and exhaust ports. As described above, the sleeve or liner 60 is inserted into the motor chamber 40 and rests against the interior wall 46 of the motor chamber. The sleeve forms the inner surface 66 of the motor chamber for contact with the rotor 50.

The rotor 50 fits within the sleeve 60 inside the motor chamber 40. The rotor 50 includes an inner cylindrical passage 52 that passes through the rotor to receive the shaft 16. The passage 52 fits closely about the external cylindrical surface of the shaft portion 16 of the carrier part 18. The rotor 50 includes a keyway 51 formed on one side of the passage 52. The keyway 51 receives a key 17 on the shaft 16. The key 17 engages the keyway 51 to transmit rotational motion from the rotor to the shaft, thereby rotationally locking the shaft 16 to the rotor 50. The key 17 is received in a groove in the shaft 16. A leaf spring 65 may be interposed radially between the rotor and key to exert radial force in opposite directions against these parts to take up any slight looseness between the parts.

A lower bearing cup 94 closes the open bottom end of the motor chamber 40. The lower bearing cup 94 is shown in FIG.

Figure 7A:
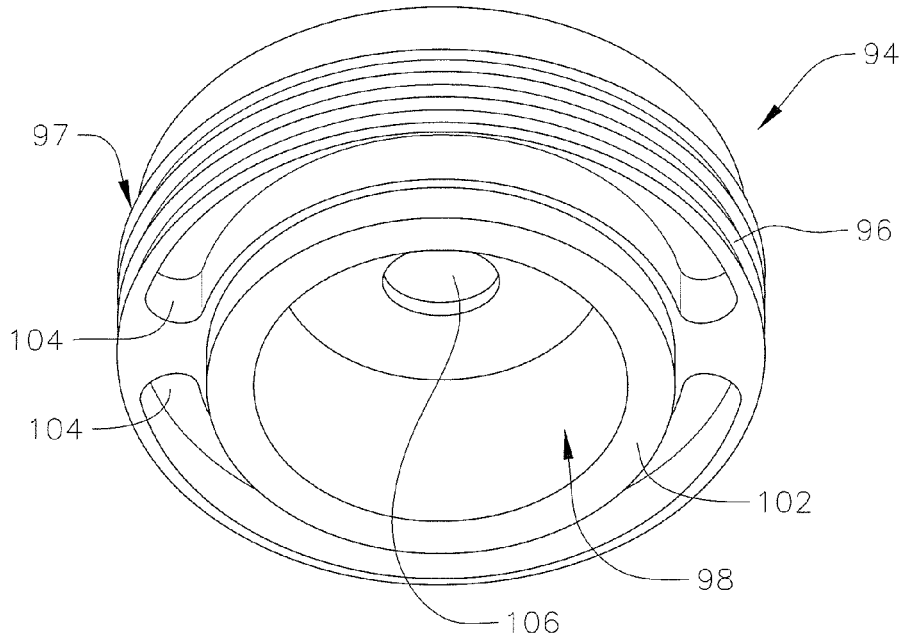
FIG. 7A is a lower perspective view of a bearing cup according to an embodiment of the invention.
Figure 7B:
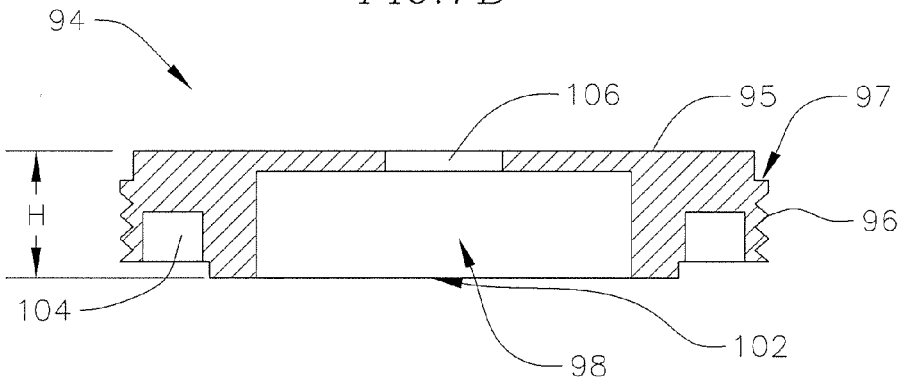
FIG. 7B is a vertical cross-sectional view of the bearing cup of FIG. 7A.

6 and in more detail in FIGS. 7A and 7B. The bearing cup 94 is attached to the interior of the body 12 to provide a floor 95 for the motor chamber. In the embodiment shown, the bearing cup 94 attaches to the body 12 via mating threads. Threads 96 on the bearing cup 94 mate with the threads 49 on the interior surface 42 of the body (see FIG. 3A). A shoulder 97 on the bearing cup 94 above the threads 96 abuts the shoulder 48 of the body 12 (see FIGS. 3A, 3B) to precisely locate the bearing cup within the interior of the body 12.

The top surface of the bearing cup 94 forms the floor 95 of the motor chamber 40. The opposite, lower side of the bearing cup is shown in FIG. 7A. The lower side of the bearing cup includes a seat 98 for receiving a lower bearing. The seat 98 includes a depression formed within a raised ring 102. Referring again to FIG. 6, a lower bearing 108 is received into the seat 98 within the ring 102. The shaft 16 passes through a passage in the lower bearing 108 and through a passage 106 in the lower bearing cup 94. The passage 106 aligns the shaft 16 with the rotor as the shaft 16 enters the motor chamber 40. The lower bearing cup 94 is precisely dimensioned and machined such that it is received snugly into the body 12 to precisely align the shaft 16.

Radially outside of the raised ring, the bearing cup 94 includes one or more depressions or recesses 104. In the embodiment shown, two depressions 104 are provided, angularly offset from each other around the bearing cup. These depressions 104 provide a mechanism for gripping and twisting the lower bearing cup 94 to engage or disengage the threads 96 with the body 12. For example, the depressions 104 can be dimensioned to engage a wrench that can be used to rotate the bearing cup 94 to assemble it to the body 12 or to removed it from the body 12. Alternatively or in addition to the depressions 104, one or more projections may be provided on the lower bearing for the same purpose. As a result, the lower bearing cup 94 can be easily removed to access the motor housing 40 to repair or replace the components therein.

In one embodiment, the bearing cup 94 is about 2 inches in outer diameter, and the passage 106 is about 0.4 inches in diameter. The height H of the bearing cup is about 0.4 inches. In one embodiment, the bearing cup is made from aluminum or other suitable metal or non-metallic material.

In one embodiment, the mating threads 96 and 49 are chosen to have the same tightening direction as the direction of rotation of the rotor 50 in the motor 14. For example, when the rotor 50 rotates clockwise (as viewed from above), the threads 96 on the bearing cup 94 are left-hand threads. Looking up at the bearing cup 94 from below as it is assembled into the body 12, the bearing cup 94 is rotated counter-clockwise to mate the threads 96 on the bearing cup with the threads 49 on the body. As a result, in the event that any rotation is passed from any of the rotating components (such as the rotor 50 or shaft 16) to the bearing cup 94, this rotation serves to further tighten the engagement of the threads 96 and 49, rather than loosening them. Thus the bearing cup 94 does not become loose and disengaged during operation of the tool. The depressions 104 enable the bearing cup 94 to be easily removed if desired for repairs or replacement.

In operation, the tool is placed on a work surface, with the lower surface of the abrading head 20 contacting the work surface. The user grips the handle 22 and pushes down on the lever 24. The lever 24 contacts and opens the valve assembly 26. The valve assembly 26 allows compressed air from source 74 to enter the motor chamber 40 and push against the vanes 58 of the rotor 50. The flow of compressed air causes the rotor 50 to rotate, and this rotation is passed via the key 17 and keyway 51 to the shaft 16. The shaft 16 rotates, along with the carrier part 18 and abrading head 20. The abrading head 20 may carry a sheet of sandpaper or other abrading or polishing material, to polish or abrade the work surface. The abrading head 20 may be offset from the shaft 16 to provide an orbital movement to the abrading head 20.

In one embodiment, a method for manufacturing a pneumatic abrading or polishing tool includes integrally forming a tool body having a hollow interior that defines an offset motor chamber with a curved internal surface. The method also includes inserting a liner against the curved internal surface of the motor chamber, inserting a lower bearing cup into the hollow interior to close the motor chamber, and providing a rotor for rotation within the motor chamber. The method may also include molding an upper bearing into the tool body above the motor chamber. The tool body may be integrally formed by injection molding.

Additional detail regarding certain structures or components of the present abrading or polishing tool, such as additional information regarding the orbital movement of the abrading head, or the attachment of the handle at the top end of the tool, or other structural details, may be found in U.S. Pat. No. 7,662,027, the contents of which are incorporated herein by reference.

Although the present invention has been described and illustrated in respect to exemplary embodiments, it is to be understood that it is not to be so limited, and changes and modifications may be made therein which are within the full intended scope of this invention as hereinafter claimed. For example, sizes and dimensions of particular components may vary. The type of abrading head can be chosen based on the application. The sleeve can be made from different materials or modified with various slots or openings as desired. The sleeve can be mounted in the motor chamber in various ways. Particular embodiments are described above, and the invention is further defined in the following claims.

What is claimed is:

1. An abrading or polishing tool, comprising:

a body defining an internal motor chamber with an inner surface;

a liner having a uniform thickness lining the inner surface of the motor chamber;

a rotor contained within the motor chamber for rotation against the liner; and an abrading or polishing head coupled to the rotor for rotation.

2. The abrading or polishing tool of claim 1, wherein the liner comprises a clock spring or a leaf spring biased against the inner surface of the motor chamber.

3. The abrading or polishing tool of claim 1, wherein the liner comprises steel.

4. The abrading or polishing tool of claim 1, wherein the liner comprises at least one opening through the liner for allowing a flow of air into or out of the motor chamber.

5. The abrading or polishing tool of claim 1, wherein the inner surface of the motor chamber comprises a rib extending out from the inner surface, and wherein the liner is seated against the rib.

6. The abrading or polishing tool of claim 1, further comprising a bearing cup attached to the body below the motor chamber to provide a floor for the motor chamber.

7. The abrading or polishing tool of claim 6, wherein the bearing cup comprises threads for assembling the bearing cup to the body, and wherein the threads match a direction of rotation of the rotor.

8. The abrading or polishing tool of claim 7, wherein the threads are left-hand threads.

9. The abrading or polishing tool of claim 6, wherein the bearing cup further comprises at least one depression or protrusion on a lower surface of the bearing cup opposite the motor chamber, for assembly and disassembly of the bearing cup.

10. The abrading or polishing tool of claim 6, wherein the bearing cup comprises a shoulder that abuts a shoulder on the body to align the bearing cup with the motor chamber.

11. The abrading or polishing tool of claim 1, wherein the motor chamber of the body is offset with respect to an axis of rotation of the rotor.

12. The abrading or polishing tool of claim 1, wherein the inner surface of the motor chamber comprises at least one recess for a flow of air into or out of the motor chamber.

13. The abrading or polishing tool of claim 1, further comprising an upper bearing molded into a top end of the body.

14. A pneumatic abrading or polishing tool, comprising:

a tool body having a hollow interior defining an integral motor chamber with an inner surface;

a sleeve lining the inner surface of the motor chamber, wherein the sleeve comprises a spring biased against the inner surface of the motor chamber;

a rotor contained within the motor chamber for rotation against the sleeve;

a carrier part coupled to the rotor for rotation therewith; and an abrading or polishing head attached to the carrier part.

15. The pneumatic abrading or polishing tool of claim 14, further comprising a lower bearing cup received in the hollow interior of the tool body below the motor chamber, and providing a floor for the motor chamber.

16. The pneumatic abrading or polishing tool of claim 14, further comprising an upper bearing molded into a top end of the tool body.

17. The pneumatic abrading or polishing tool of claim 14, wherein the inner surface comprises a rib for aligning the spring.

* * * * *